US008757061B2

(12) United States Patent
Goetz et al.

(10) Patent No.: US 8,757,061 B2
(45) Date of Patent: Jun. 24, 2014

(54) METHOD FOR APPLYING POWDER TO A PRINTED SHEET AND PRINTING PRESS FOR CARRYING OUT THE METHOD

(75) Inventors: Reiner Goetz, Stuttgart (DE); Claudius Haas, Nussloch (DE); Reiner Haas, Metzingen (DE); Marius Stelter, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1949 days.

(21) Appl. No.: 11/729,389

(22) Filed: Mar. 28, 2007

(65) Prior Publication Data

US 2007/0227381 A1 Oct. 4, 2007

(30) Foreign Application Priority Data

Mar. 28, 2006 (DE) ..... 10 2006 014 252

(51) Int. Cl.
*B41F 22/00* (2006.01)

(52) U.S. Cl.
USPC ..... 101/420; 427/180; 427/427.1

(58) Field of Classification Search
USPC ..... 101/420
See application file for complete search history.

(56) References Cited

U.S. PATENT DOCUMENTS

| | | | | |
|---|---|---|---|---|
| 2,078,790 | A * | 4/1937 | Bucy | 101/420 |
| 2,266,849 | A * | 12/1941 | Cole | 101/420 |
| 4,024,815 | A * | 5/1977 | Platsch | 101/416.1 |
| 5,431,386 | A * | 7/1995 | Blaser | 271/204 |
| 5,443,005 | A * | 8/1995 | Platsch | 101/424.2 |
| 5,516,096 | A * | 5/1996 | Whiteside et al. | 271/277 |
| 6,267,540 | B1 * | 7/2001 | Haas | 406/153 |
| 6,413,580 | B1 | 7/2002 | Haas et al. | |
| 6,648,972 | B1 * | 11/2003 | Stober et al. | 101/483 |
| 6,708,615 | B2 | 3/2004 | Sugiyama | |
| 7,427,064 | B2 | 9/2008 | Förch et al. | |
| 2004/0113350 | A1 * | 6/2004 | Forch et al. | 271/204 |
| 2006/0022398 | A1 * | 2/2006 | Forch et al. | 271/188 |

FOREIGN PATENT DOCUMENTS

| | | | |
|---|---|---|---|
| CN | 1448266 | A | 10/2003 |
| DE | 197 33 691 | A1 | 6/1998 |
| DE | 197 03 626 | A1 | 8/1998 |
| DE | 197 51 383 | A1 | 5/1999 |
| DE | 10 2004 053 099 | A1 | 6/2005 |
| JP | 6032508 | A | 2/1994 |
| JP | 200326634 | A | 9/2003 |
| JP | 2006035861 | A | 2/2006 |

* cited by examiner

*Primary Examiner* — Jill Culler
(74) *Attorney, Agent, or Firm* — Laurence A. Greenberg; Werner H. Stemer; Ralph E. Locher

(57) ABSTRACT

A method for applying powder to a printed sheet includes ejecting air flows from a nozzle bar. The air flows are set in such a way that the air flows which are ejected per meter length of the nozzle bar produce a resultant force acting on the printed sheet of from 0.5 newtons to 16 newtons. A printing press for carrying out the method is also provided.

2 Claims, 3 Drawing Sheets

METHOD FOR APPLYING POWDER TO A PRINTED SHEET AND PRINTING PRESS FOR CARRYING OUT THE METHOD

CROSS-REFERENCE TO RELATED APPLICATION

This application claims the priority, under 35 U.S.C. §119, of German Patent Application DE 10 2006 014 252.7, filed Mar. 28, 2006; the prior application is herewith incorporated by reference in its entirety.

BACKGROUND OF THE INVENTION

Field of the Invention

The present invention relates to a method for applying powder to a printed sheet, in which air flows are ejected from a nozzle bar. The invention also relates to a printing press for carrying out the method.

Printed sheets are powdered in deliveries of printing presses, in order to prevent ink transfer from one sheet to the other in a delivery stack. A defined powder amount has to be applied per sheet in order to ensure that this aim is achieved. For that purpose, powdering apparatuses are used which eject the powder in a powder air flow from a nozzle bar. Since not all of the ejected powder amount adheres to the sheet, operation has to take place with a defined powder excess. However, that powder excess should be kept as small as possible, because it leads to contamination of the delivery.

It could be assumed that more effective powdering could be achieved and therefore the powder loss could be reduced, by setting the powder air flow to be more powerful.

However, it is apparent from German Patent DE 197 51 383 B4, corresponding to U.S. Pat. No. 6,413,580, that excessively powerful setting of the powder air flow has a disadvantageous effect on the sheet run. It is specified in that prior art that it is disadvantageous to load the sheet with a relatively large "air impulse flow" which lies in a region of 0.04 newtons.

Furthermore, German Published, Non-Prosecuted Patent Application DE 2004 053 099 A1 describes a printing press having a delivery which has gripper bars for fixedly holding the respective sheet at its front edge and rear edge at the same time.

SUMMARY OF THE INVENTION

It is accordingly an object of the invention to provide a method for applying powder to a printed sheet and a printing press for carrying out the method, which overcome the hereinafore-mentioned disadvantages of the heretofore-known methods and devices of this general type and with which more effective powdering is ensured.

With the foregoing and other objects in view there is provided, in accordance with the invention, a method for applying powder to a printed sheet. The method comprises ejecting air flows from a nozzle bar. The ejection of the air flows per meter length of the nozzle bar is set to produce a resultant force acting on the printed sheet of from 0.5 newtons to 16 newtons. The airflows can be powder air flows which contain the powder or supporting air flows which envelop the powder air flows at least partially.

The magnitude of the resultant force which lies in the range of from 0.5 newtons to 16 newtons is therefore at least more than ten times the magnitude which is specified in German Patent DE 197 51 383 B4, corresponding to U.S. Pat. No. 6,413,580.

In accordance with another feature of the invention, the resultant force lies in a range of from 3.5 newtons to 10 newtons, and preferably in a range of from 4.0 newtons to 5.0 newtons. In the last-mentioned development, the magnitude of the resultant force is therefore at least 100 times the magnitude which is specified in German Patent DE 197 51 383 B4, corresponding to U.S. Pat. No. 6,413,580.

In accordance with a further feature of the invention, the printed sheet is transported past the nozzle bar through the use of a transport device, and a rear edge of the printed sheet is fixed in the process through the use of the transport device. In this context, the transport device is understood to be a moving transport device which is therefore different than an immovable sheet guiding device. The rear edge has a substantially constant vertical spacing relative to the nozzle bar, as a result of the rear edge being fixed. The transport device can be a conveyor belt, on which the sheet rests, including its rear edge. Instead of the conveyor belt, a plurality of conveying belts which run in parallel can also be used. The rear edge can be fixed on the transport device only under the action of the air flows, which presses the rear edge against the transport device. In this case, the rear edge is supported by the transport device on the sheet side which faces away from the air flows. However, there can also be provision for the rear edge to be attracted by suction by the transport device, in order to fix the rear edge. For example, the above-mentioned conveyor belt can be a suction belt.

In accordance with an added feature of the invention, the transport device includes a front gripper bar and a rear gripper bar, a front edge of the printed sheet is held fixedly through the use of the front gripper bar, and the rear edge of the printed sheet is held fixedly at the same time through the use of the rear gripper bar. Tests have shown that a printed sheet which is clamped at both ends in the gripper bars in this way has a sufficiently stable sheet run which permits loading of the sheet with extraordinarily powerful air flows. Surprisingly, the pressure of the air flows can even be increased to such an extent that the resultant force of the air flows which acts on the sheet achieves the magnitude which was specified in the previous text. It has been proven that fluttering movements of the rear edge of the sheet, which were otherwise caused by the extraordinarily powerful air flows, are suppressed reliably by the rear gripper bar. The rear gripper bar is capable of applying sufficiently high clamping forces, by way of which the sheet is held reliably and the risk of the rear edge of the sheet being ripped out of the rear gripper bar, which is conceivable due to the high resultant force of the air flows, can be precluded. An absolutely stable, undisrupted sheet run is therefore ensured.

With the objects of the invention in view, there is also provided a printing press for carrying out the method according to the invention.

Other features which are considered as characteristic for the invention are set forth in the appended claims.

Although the invention is illustrated and described herein as embodied in a method for applying powder to a printed sheet and a printing press for carrying out the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
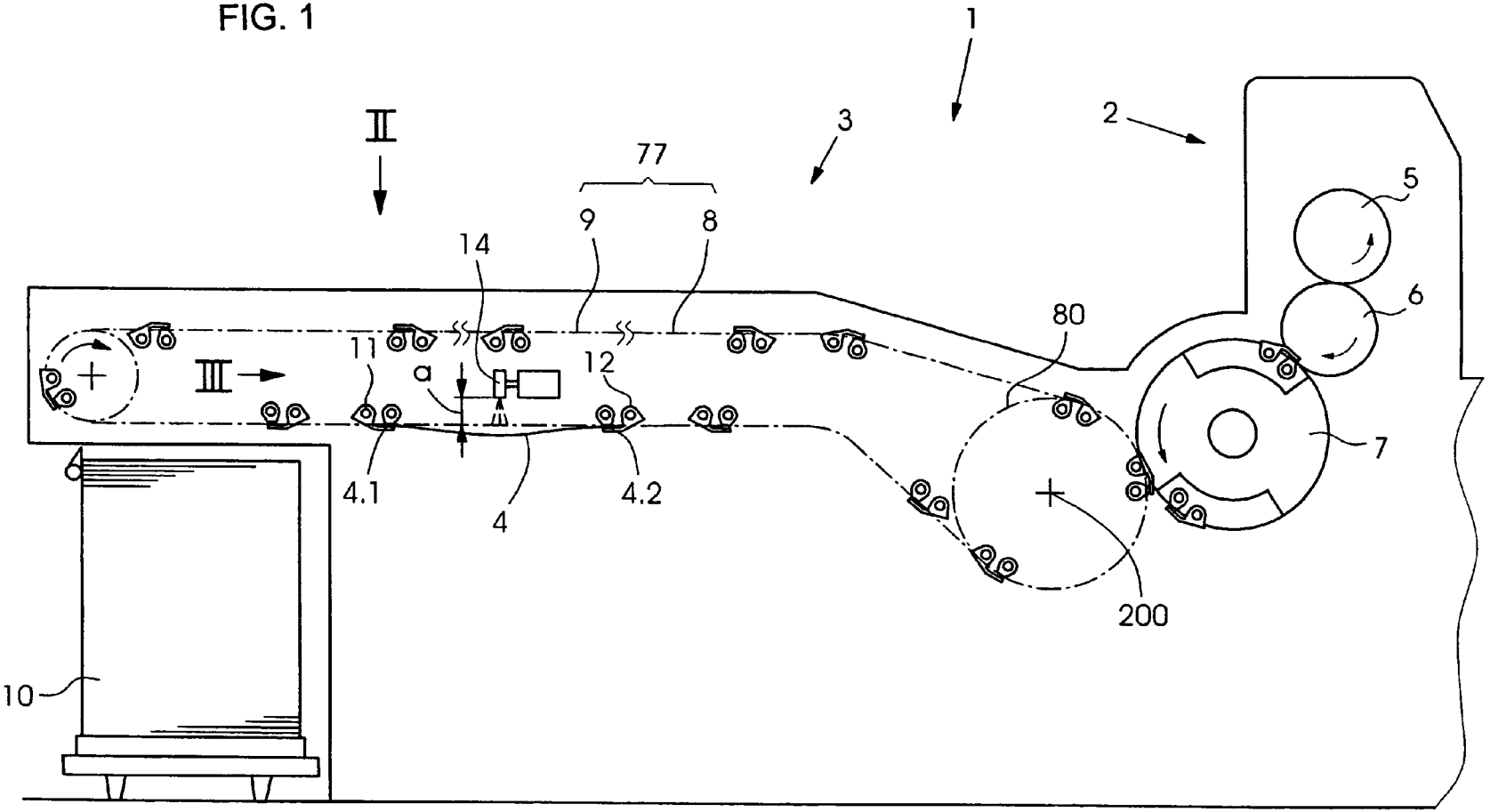
FIG. 1 is a diagrammatic, side-elevational view of a printing press having a delivery.

Referring now to the figures of the drawings in detail and first, particularly, to FIG. 1 thereof, there is seen a printing press 1 having a lithographic printing unit 2 and a delivery 3 for sheets 4 made of printing material. The printing unit 2 includes, for offset printing, a printing form cylinder 5, a blanket cylinder 6 and an impression cylinder 7. The delivery 3 has a sheet transport device 77 having a first chain conveyor 8 and a second chain conveyor 9 which transport the sheets 4 to a delivery stack 10 and rotate synchronously with one another in the process. The first chain conveyor 8 includes front gripper bars 11 for holding the sheets 4 at their respective leading sheet end 4.1 or edge (front edge), and the second chain conveyor 9 includes rear gripper bars 12 for holding the sheets 4 at their respective trailing sheet end 4.2 or edge (rear edge). The gripper bars 11, 12 act as holding devices for holding the sheets 4 at both ends.

Figure 2:
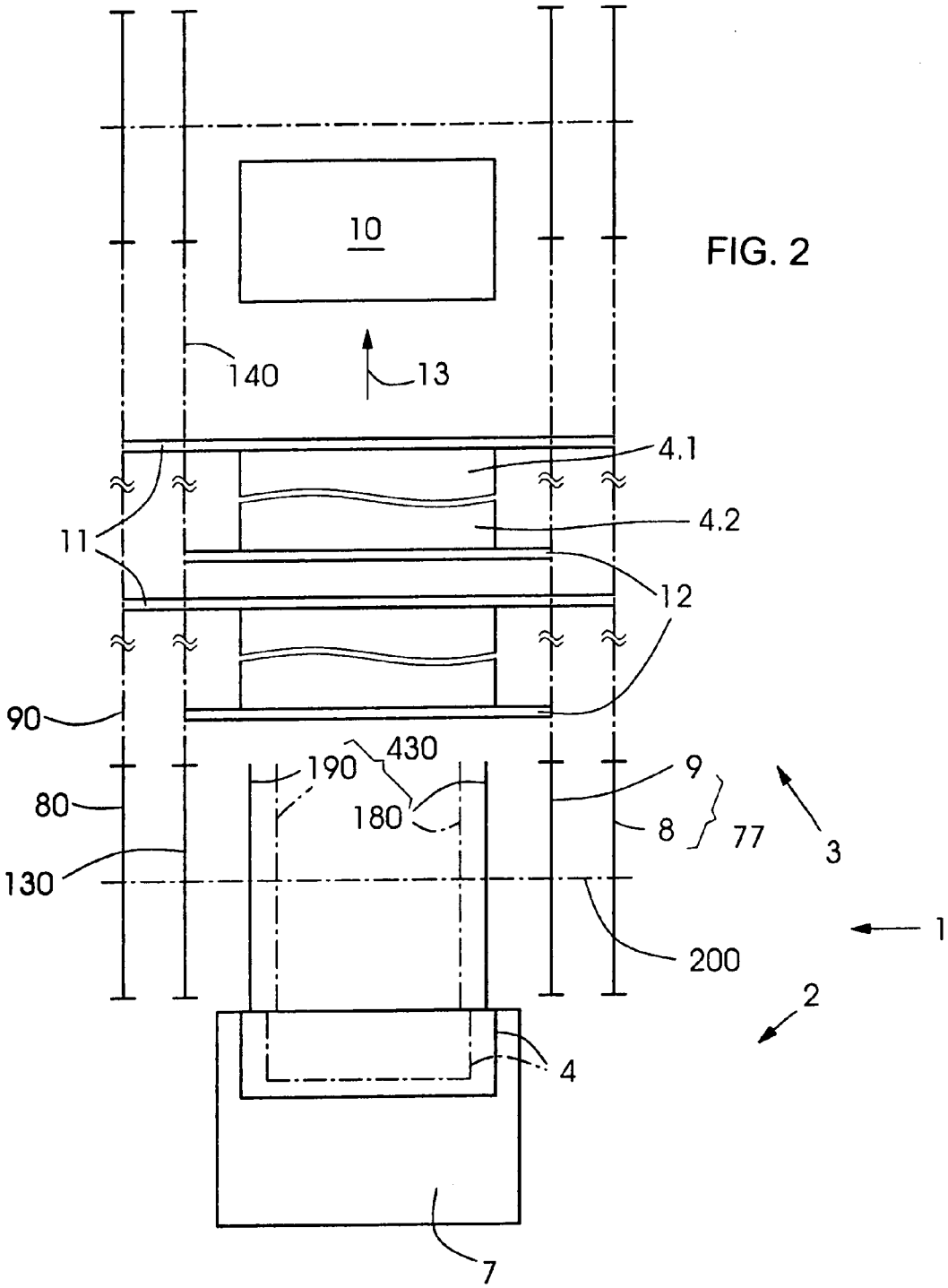
FIG. 2 is a top-plan view of the delivery, as seen from a viewing direction II in FIG. 1.

With reference to FIG. 2, it is seen that the first chain conveyor 8 includes a pair of endless chains 90 which carry the front gripper bars 11 between them, and the second chain conveyor 9 includes another pair of endless chains 140 which carry the rear gripper bars 12 between them. Each sheet 4 is therefore held fixedly, during its transport which takes place in a running direction 13, through the use of a front gripper bar 11 and at the same time through the use of a rear gripper bar 12.

A powdering apparatus seen in FIG. 1 has a nozzle bar 14 which is disposed within circulating paths of the chain conveyors 8, 9. The nozzle bar 14 is disposed at a spacing a relative to the sheet transport path and substantially also with respect to the printed sheet 4 which sags a little between the gripper bars 11, 12. The spacing a is at least 80 mm and at most 300 mm. The spacing preferably lies in a range of from 100 mm to 200 mm.

As is shown in FIG. 2, the first chain conveyor 8 has one gearwheel or chain sprocket 80 on each of a drive side and an operating side and the respective endless chain 90 which circulates around the latter. The endless chains 90 of the first chain conveyor 8 carry the gripper bars 11 which lead between them in the running direction 13, in order to hold the leading sheet ends 4.1 of the sheets 4. The second chain conveyor 9 likewise includes a chain sprocket 130 on each of the two machine sides and the respective endless chain 140 which circulates around the latter. The endless chains 140 of the second chain conveyor 9 carry the trailing gripper bars 12 between them, in order to hold the sheet ends 4.2 which trail in the running direction 13. Each one of the leading gripper bars 11, together with a respective one of the trailing gripper bars 12, forms a gripper bar pair which holds the respective sheet 4 fixedly at both ends during its transport which takes place toward the delivery stack 10. As a result of a phase adjustment of one chain conveyor 8 relative to the other chain conveyor 9, the format of a gripper bar spacing between the rear gripper bar 12 and the front gripper bar 11 of each gripper bar pair can be set as a function of the sheet length of the respective print job.

A sheet support 180 which lies toward the drive side and a sheet support 190 which lies toward the operating side, are structurally identical with one another and serve to press the respective sheet 4 against the circumferential surface of the impression cylinder 7. The sheet supports 180, 190 are constituent parts of a delivery drum 430 of the delivery 3. The delivery drum 430 is configured in a skeleton construction, and can be adjusted along its geometrical rotational axis 200, which is also the rotational axis of the chain sprockets 80, 130, in an infinitely variable manner. Therefore, the delivery drum 430 can be adjusted from a format setting (shown with a solid line in FIG. 2) for a maximum sheet width of the sheets 4 to a format setting (indicated with a phantom line in FIG. 2) for a minimum sheet width, as well as into intermediate positions which lie between these two extreme positions for medium sheet widths. In each format setting, the drive-side sheet support 180 is aligned with one printfree side edge and the operating-side sheet support 190 is aligned with another printfree side edge, of the respective sheet 4. The sheet supports 180, 190 are mounted in such a way that they can be displaced axially by motor, between those chain sprockets of the chain conveyors 8, 9 which are disposed on the drive side and those chain sprockets which are disposed on the operating side. The drive (motor, gear mechanism) which is required for the axial displacement of the sheet supports 180, 190 that can take place optionally toward one another or away from one another, is not shown in FIG. 2 for reasons of improved clarity.

Figure 3:
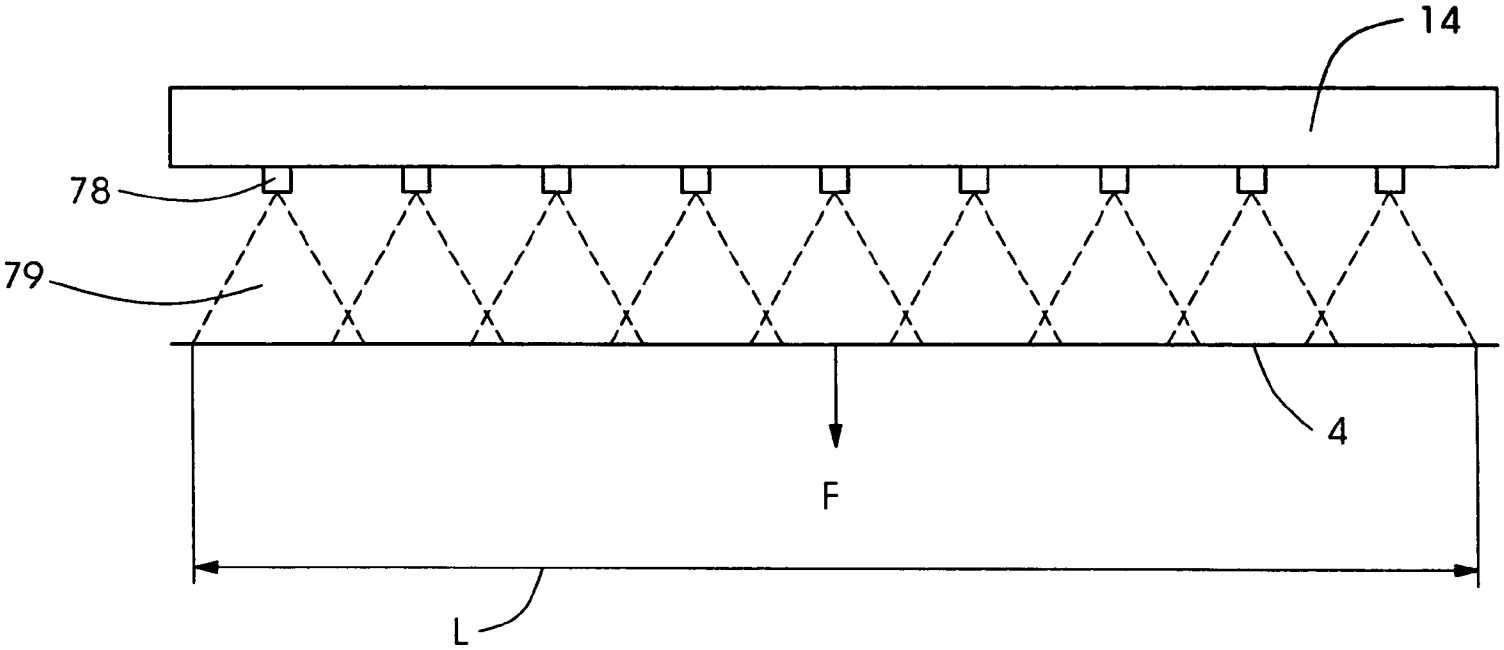
FIG. 3 is a rear-elevational view of a nozzle bar of the printing press, as seen from a viewing direction III in FIG. 1.

FIG. 3 shows the nozzle bar 14 which extends substantially over the entire width of the printed sheet 4. The nozzle bar 14 includes nozzles 78 which are disposed in a row. In the simplest case, the nozzle bar 14 could be a tube, in the wall of which the nozzles 78 are formed as bores. In the case which is more relevant in practice, the nozzle bar 14 includes a holding crossmember, to which the nozzles 78 are fastened as nozzle heads. In the example which is shown in the drawing, an effective length L of the nozzle bar 14 is precisely 1 meter. Each nozzle 78 ejects an air flow in the form of a powder air flow 79, which guides the powder in the direction of the printed sheet 4. The outlet velocity of the air flow from the nozzle 78 is approximately 170 meters per second. The powder air flows 79 exert forces on the printed sheet 4 when they impinge on it. The force which results from these forces is denoted by the designation F and is 4.0 newtons. The force F is a specific force which is related to a length unit (1 meter) of the nozzle bar 14.

We claim:

1. A method for applying powder to a printed sheet, the method comprising the following steps:

ejecting air flows from a nozzle bar;

setting the ejection of the air flows per meter length of the nozzle bar to produce a resultant force acting on the printed sheet of from 3.5 newtons to 10 newtons;

transporting the printed sheet past the nozzle bar with a transport device including:

a first chain conveyor having a first pair of endless chains carrying front gripper bars, and a second chain conveyor having a second pair of endless chains carrying rear gripper bars; and holding a front edge of the printed sheet with one of the front gripper bars and simultaneously holding a rear edge of the printed sheet with one of the rear gripper bars during transport.

2. The method according to claim 1, which further comprises setting the resultant force acting on the printed sheet to from 4.0 newtons to 5.0 newtons.

* * * * *